US012692442B2

(12) United States Patent
Saffrin et al.

(10) Patent No.: US 12,692,442 B2
(45) Date of Patent: Jul. 28, 2026

(54) DUCT FOR A HEATING WALL OF A COKE OVEN OR COKE OVEN BATTERY

(71) Applicant: VANOCUR REFRACTORIES LLC, Tonawanda, NY (US)

(72) Inventors: Paul A. Saffrin, Tonawanda, NY (US); Richard M. Maida, Tonawanda, NY (US)

(73) Assignee: VANOCUR REFRACTORIES LLC, Tonawanda, NY (US)

( * ) Notice: Subject to any disclaimer, the term of this patent is extended or adjusted under 35 U.S.C. 154(b) by 190 days.

(21) Appl. No.: 18/701,467

(22) PCT Filed: Oct. 14, 2022

(86) PCT No.: PCT/US2022/078133

§ 371 (c)(1),
(2) Date: Apr. 15, 2024

(87) PCT Pub. No.: WO2023/064912

PCT Pub. Date: Apr. 20, 2023

(65) Prior Publication Data

US 2024/0417622 A1 Dec. 19, 2024

Related U.S. Application Data

(60) Provisional application No. 63/262,569, filed on Oct. 15, 2021.

(51) Int. Cl.
*C10B 5/04* (2006.01)
*C10B 29/02* (2006.01)

(52) U.S. Cl.
CPC ..... *C10B 5/04* (2013.01); *C10B 29/02* (2013.01)

(58) Field of Classification Search
CPC ..... C10B 29/02; C10B 29/06
See application file for complete search history.

(56) References Cited

U.S. PATENT DOCUMENTS 1,508,040 A * 9/1924 Wilputte ..... C10B 5/02 202/139
1,603,992 A * 10/1926 Sommer ..... C10B 5/02 202/141

(Continued)

FOREIGN PATENT DOCUMENTS

DE 4103737 A1 8/1991
EP 0527318 A2 2/1993

(Continued)

OTHER PUBLICATIONS

Espacenet translation of JP 2017-137447 A.*

(Continued)

*Primary Examiner* — Jonathan Luke Pilcher
(74) *Attorney, Agent, or Firm* — Simpson & Simpson, PLLC

(57) ABSTRACT

A duct operatively arranged to fluidly connect a first flue of a heating wall of a coke oven battery with a second flue of the heating wall, the duct comprising a first end, second end, a distal end and a proximal end, a passageway disposed therein, the passageway extending from the first end to the second end, a pair of proximal apertures disposed within the proximal end and open to the passageway, and a pair of distal apertures disposed within the proximal end and open to the passageway, the distal apertures arranged be in fluid communication with the passageway, wherein one of the distal apertures is arranged to be in fluid communication with the first flue of the coke oven battery and the other of the distal apertures is arranged to be in fluid communication with the second flue of the coke oven battery.

10 Claims, 8 Drawing Sheets

(56) References Cited

U.S. PATENT DOCUMENTS

| | | | | |
|---|---|---|---|---|
| 1,706,476 | A | 3/1929 | Becker | |
| 1,754,131 | A | 4/1930 | Ackeren | |
| 1,989,505 | A * | 1/1935 | Christianson | C10B 5/10 202/144 |
| 2,294,005 | A | 8/1942 | Alan et al. | |
| 2,863,807 | A | 12/1958 | Ackeren | |
| 3,661,720 | A | 5/1972 | Jakobi | |
| 4,249,997 | A | 2/1981 | Schmitz | |
| 4,704,195 | A | 11/1987 | Janicka | |
| 5,423,152 | A | 6/1995 | Kolvek | |
| 6,066,236 | A | 5/2000 | Gilroy | |
| 2008/0169578 | A1 | 7/2008 | Crane et al. | |
| 2018/0362854 | A1 | 12/2018 | Bowser, Jr. et al. | |

FOREIGN PATENT DOCUMENTS

| | | | | |
|---|---|---|---|---|
| GB | 155316 | A | 12/1920 | |
| GB | 432345 | A | 7/1935 | |
| JP | 2016222758 | A | 12/2016 | |
| JP | 2017137447 | A | 8/2017 | |
| JP | 6573837 | B2 * | 9/2019 | C10B 29/06 |

OTHER PUBLICATIONS

PE2E translation of JP 6573837 B2.*
1 European Patent Office, Extended European Search Report, Jan. 24, 2025, Munich, Germany.

* cited by examiner

DUCT FOR A HEATING WALL OF A COKE OVEN OR COKE OVEN BATTERY

CROSS-REFERENCE TO RELATED APPLICATIONS

This application claims the benefit under Articles 4 and 8 of the Stockholm Act of the Paris Convention for the Protection of Industrial Property of U.S. Provisional Patent Application No. 63/262,569, filed on Oct. 15, 2021, which application is hereby incorporated by reference herein in its entirety.

FIELD

The present invention relates to coke ovens, and, more particularly, to a duct that connects different flues of a heating wall to regulate the temperature and exhaust gases therein.

BACKGROUND

Coke is typically produced by heating coal in a coke oven battery. This battery may have anywhere from 40 to over 100 side-by-side coking chambers or ovens separated from each other by heating walls. Gas is burned within the walls to heat the coal arranged in the ovens. The floor bricks of each oven rest upon corbels. Below the corbels is an area called the regenerator. The regenerator is filled with bricks that have a relatively large amount of surface area per volume, generally due to slots formed in the bricks. In the regenerator, exhaust waste heat is used to pre-heat incoming air as well as cool the exhaust waste prior to discharge. The slotted bricks are called checker bricks, and they facilitate the heat transfer from the exhaust waste heat to the combustion materials. The regenerator supports the corbels. In turn, the corbels support the coke oven floor bricks and the heating walls. The heating walls, floor bricks, and corbels have traditionally been made of silica brick.

However, current coke oven battery designs only circulate and/or vent exhaust gases within the specific flue of the heating wall. Specifically, exhaust gases are forced out of the single flue, down through the corbel, and into the regenerator. Such designs do not allow for optimal air flow within the heating wall, specifically the flue, and lead to undesirable heating characteristics (i.e., loss of heat, increased fluid pressure within the flue, etc.). Such designs may also promote premature failure of the flues, such as leaks from expanded seams (caused by irregular heating and cooling, increased fluid pressure within the flue, etc.) between the blocks that comprise the flues.

Thus, there is a long felt need for a duct for a heating wall that connects two different flues within the heating wall and improves air and gas flow therein.

There is also a long felt need for a duct for a heating wall that connects to two different flues within the heating wall, improves air and gas flow therein, improves heating and cooling regulation, thereby reducing potential leak points between seams of adjacent blocks that comprise the duct for the heating wall.

There is a further long felt need for a duct for a heating wall that connects to two different flues within the heating wall having at least two pathways for heat and/or gas to be exchanged.

There is an even further long felt need for a duct for a heating wall that connects to two different flues within the heating wall where the individual sections of the duct have a male and female mating configuration to decrease potential movement of the ducts after extended use.

There is still a further long felt need for a duct for a heating wall that connects to two different flues within the heating wall where each respective duct includes a recessed end and a protruding end arranged to mate with an adjacent duct's recessed end and protruding end (i.e., protruding ends mate with recessed ends), such that a barrier is created preventing a straight mortar joint that runs from wall to wall, and into the oven chamber.

SUMMARY

According to aspects illustrated herein, the present invention generally comprises a duct operatively arranged to fluidly connect a first flue of a heating wall of a coke oven battery with a second flue of the heating wall, the duct comprising a first end, second end, a distal end and a proximal end, a passageway disposed therein, the passageway extending from the first end to the second end, a pair of proximal apertures disposed within the proximal end and open to the passageway, and a pair of distal apertures disposed within the proximal end and open to the passageway, the distal apertures arranged be in fluid communication with the passageway, wherein one of the distal apertures is arranged to be in fluid communication with the first flue of the coke oven battery and the other of the distal apertures is arranged to be in fluid communication with the second flue of the coke oven battery.

In some configurations, the present invention may also generally comprise a duct operatively arranged to fluidly connect a first flue of a heating wall of a coke oven battery with a second flue of the heating wall, the duct comprises a bottom section having a first end and a second end, the bottom section having an external surface and an internal surface, the bottom section having a channel disposed within the internal surface extending from the first end to the second end, the channel having a pair of apertures disposed therein, and a top section having a first end and a second end, the top section having an external surface and an internal surface, the top section having a channel disposed within the internal surface extending from the first end to the second end, the channel having a pair of apertures disposed therein, wherein the bottom section is arranged to accept the top section thereon forming a passageway comprising the channel of the bottom section and the channel of the top section.

In some embodiments, the bottom section of the duct may include at least one groove arranged proximate the channel and arranged within the internal surface, the at least one groove extending from the first end to the second end, and the top section includes at least one protrusion arranged proximate the channel and extending from the internal surface, the at least one protrusion extending from the first end to the second end, where the at least one groove of the bottom section is arranged to accept the at least one protrusion of the top section therein.

In even further embodiments, the channel of the bottom section further includes a second channel disposed therein, the pair of apertures disposed within the second channel.

In still further embodiments, the duct of the present invention may further comprise a mating projection extending from the first end of the bottom section, and a mating recess disposed within the second end of the bottom section, and a mating projection extending from the first end of the top section, and a mating recess disposed within the second end of the top section, wherein the mating projection of the top section is arranged to engage a mating recess of a top section of an adjacently arranged duct and wherein the mating projection of the bottom section is arranged to engage a mating recess of a bottom section of the adjacently arranged duct.

In other configurations, the bottom section of the duct of the present invention includes at least one protrusion extending from the external surface and extending from the first end to the second end, wherein the top section includes at least one groove arranged within the external surface and extending from the first end to the second end.

In some further embodiments, the second channel of the bottom section of the duct of the present invention may further comprise a plate, the plate arranged to be removably seated within the second channel, the plate further arranged to cover at least one of the pair of apertures disposed within the second channel.

In a still further configuration of the duct of the present invention, each of the pair of apertures of the top section are arranged to be substantially aligned with an inspection casting arranged on the external surface of the top section.

In other embodiments of the present invention, one of the pair of apertures of the bottom section is arranged to be in communication with the first flue of the heating wall of the coke oven battery and the other of the pair of apertures of the bottom section is arranged to be in communication with the second flue of the heating wall of the coke oven battery.

In other configurations, the present invention may generally comprise a coke oven battery, the coke oven battery comprising a heating wall, where the heating wall includes a first flue, and a second flue spaced apart from the first flue, and a duct, the duct comprises a bottom section having a first end and a second end, the bottom section having an external surface and an internal surface, the bottom section having a channel disposed within the internal surface extending from the first end to the second end, the channel having a pair of apertures disposed therein, one of the pair of apertures in fluid communication with the first flue, another of the pair apertures in fluid communication with the second flue, and a top section having a first end and a second end, the top section having an external surface and an internal surface, the top section having a channel disposed within the internal surface extending from the first end to the second end, the channel having a pair of apertures disposed therein, where the bottom section is arranged to accept the top section thereon forming a passageway comprising the channel of the bottom section and the channel of the top section.

These and other objects, features, and advantages of the present disclosure will become readily apparent upon a review of the following detailed description of the disclosure, in view of the drawings and appended claims.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

Figure 1:
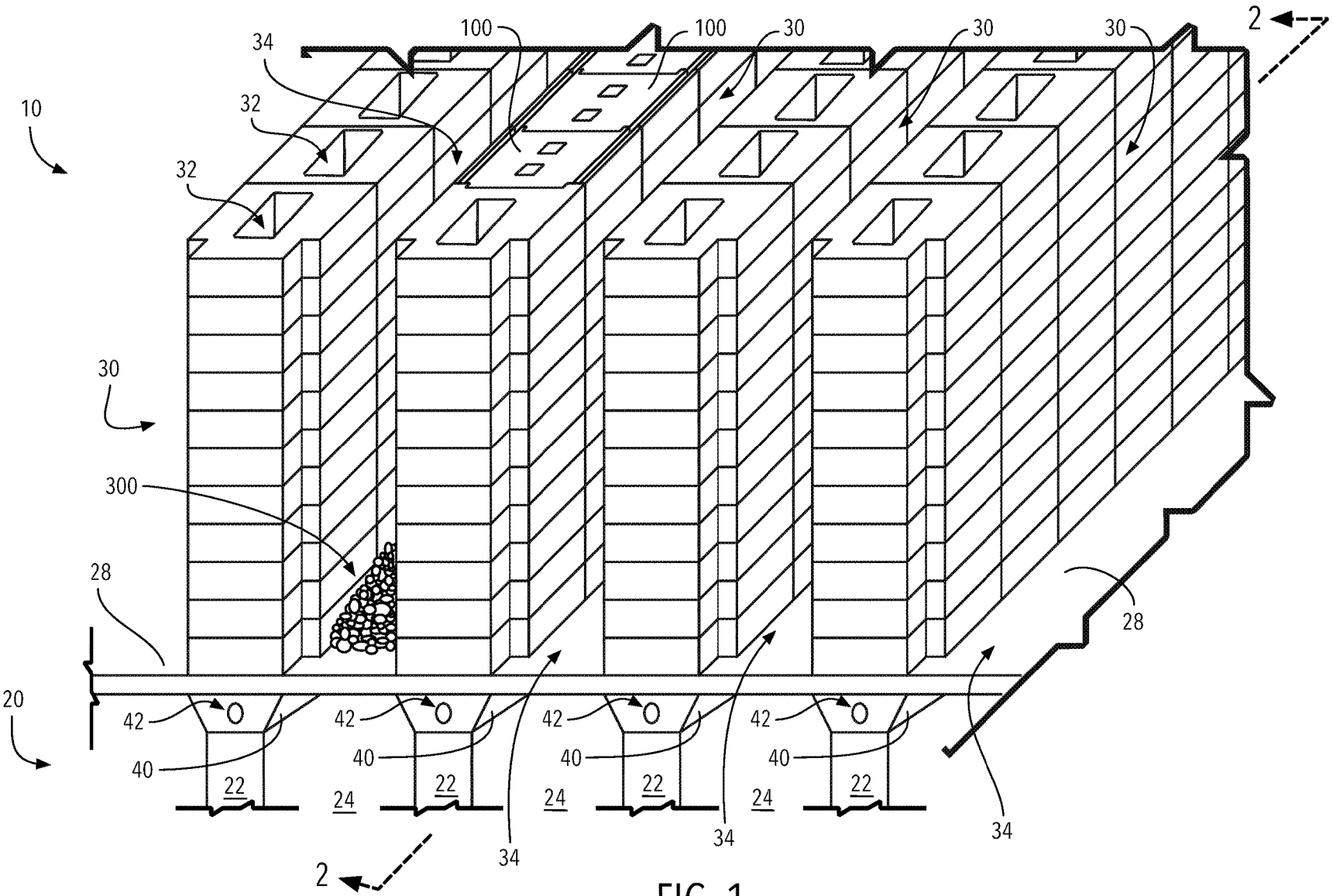
FIG. 1 is a partial perspective view of a coke oven battery, in accordance with some embodiments of the present invention.

At the outset, it should be appreciated that like drawing numbers on different drawing views identify identical, or functionally similar, structural elements. It is to be understood that the claims are not limited to the disclosed aspects.

As shown in the drawings, leader lines terminated by a solid circle, should be interpreted as indicating a surface of a particular area of a drawing, unless otherwise and explicitly stated herein.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the claims.

Unless defined otherwise, all technical and scientific terms used herein have the same meaning as commonly understood to one of ordinary skill in the art to which this disclosure pertains. It should be understood that any methods, devices or materials similar or equivalent to those described herein can be used in the practice or testing of the example embodiments. The assembly of the present disclosure could be driven by hydraulics, electronics, pneumatics, and/or springs.

It should be appreciated that the term "substantially" is synonymous with terms such as "nearly," "very nearly," "about," "approximately," "around," "bordering on," "close to," "essentially," "in the neighborhood of," "in the vicinity of," etc., and such terms may be used interchangeably as appearing in the specification and claims. It should be appreciated that the term "proximate" is synonymous with terms such as "nearby," "close," "adjacent," "neighboring," "immediate," "adjoining," etc., and such terms may be used interchangeably as appearing in the specification and claims. The term "approximately" is intended to mean values within ten percent of the specified value.

It should be understood that use of "or" in the present application is with respect to a "non-exclusive" arrangement, unless stated otherwise. For example, when saying that "item x is A or B," it is understood that this can mean one of the following: (1) item x is only one or the other of A and B; (2) item x is both A and B. Alternately stated, the word "or" is not used to define an "exclusive or" arrangement. For example, an "exclusive or" arrangement for the statement "item x is A or B" would require that x can be only one of A and B. Furthermore, as used herein, "and/or" is intended to mean a grammatical conjunction used to indicate that one or more of the elements or conditions recited may be included or occur. For example, a device comprising a first element, a second element and/or a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element.

Moreover, as used herein, the phrases "comprises at least one of" and "comprising at least one of" in combination with a system or element is intended to mean that the system or element includes one or more of the elements listed after the phrase. For example, a device comprising at least one of: a first element; a second element; and, a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element. A similar interpretation is intended when the phrase "used in at least one of:" is used herein.

As used herein, "vent" is meant to mean an opening that allows gases, and/or fluid, to pass out of or into a confined space, such as a duct.

Coke Oven Battery

Figure 2:
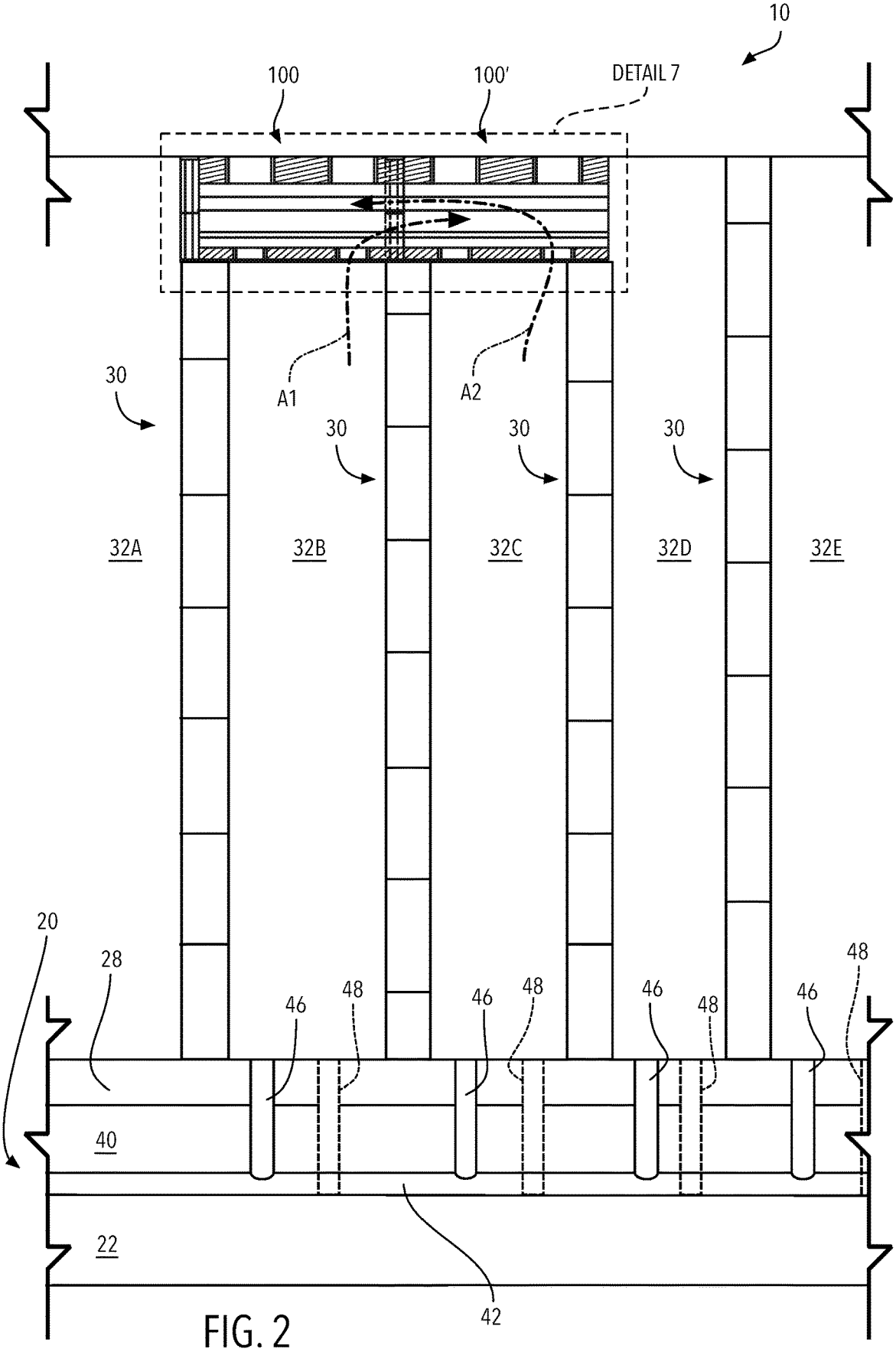
FIG. 2 is a partial cross-sectional view of the coke oven battery taken generally along line 2-2 in FIG. 1.

Referring now to the figures, the following description should be taken in view of FIGS. 1 and 2, as these figures generally illustrate a partial perspective view of coke oven battery 10 and a partial cross-sectional view of coke oven battery 10 taken generally along line 2-2 in FIG. 1, respectively. Coke oven battery 10 generally comprises regenerator 20 and one or more ovens 34.

Regenerator 20 comprises a plurality of piers or pillars 22, which are spaced apart to form regenerator regions 24. In some embodiments, each of pillars 22 comprises a plurality of bricks or blocks. Pillars 20 support corbels 40. In some embodiments, each of corbels 40 may comprise a plurality of blocks and, in alternative configurations, corbels 40 may comprise a plurality of blocks arranged in a plurality of tiers.

Generally, corbels 40 are arranged on top of pillars 20 and support the oven section of coke oven battery 10. Specifically, corbels 40 support floor 28, heating walls 30, and coal 300 placed in ovens 34, allow air to flow between flues 32 and regenerator 20, and/or allow gas to be injected into flues 32. (Coal 300 shown in the drawing is merely representative. In practice, the coal is crushed and blended prior to being charged in the coke oven.) For example, gas or fuel is injected into corbels 40 horizontally via through-bore 42 and flows vertically through holes 46 and into flues 32. Air flows upwardly through holes 48 and into flues 32 where it mixes with the fuel and combusts to heat heating walls 30, thus cooking the coal arranged in ovens 34 transforming it into coke. Exhaust gasses are created from such combustion and these hot exhaust gases may flow down through holes 48 and into regenerator regions 24, thereby preheating the incoming gas and/or air. Preheating gas and/or air as it flows into flues prior to combustion is desirable because it produces more efficient vaporization and higher combustion efficiency than cold fuel. In some configurations, coke oven battery 10 further comprises shut-off means (not illustrated) operatively arranged to selectively shut off the gas flow through one or more holes 42. The shut-off means (e.g., valves) allow the operator to control the temperature in each flue 32 and thus ovens 34. In other configurations, and as shown, coke oven battery 10 further comprises one or more ducts 100 operatively arranged to facilitate the transfer of gasses between the various flues of a single heating wall, as will be described in greater detail, infra.

Floor 28 is arranged on and/or engaged with corbels 40. Floor 28 is operatively arranged to support the coal in ovens 34. Floor 28 may comprise a plurality of blocks, where in other configurations, floor 28 may comprise a plurality of blocks arranged in a plurality of tiers. Heating walls 30 are arranged on corbels 40 and/or floor 28 and comprise flues 32 arranged therein, respectively. (Heating walls 30 are comprised of bricks, blocks and/or modules.) Flues 32 are in fluid communication with holes 46 and holes 48. An oven ceiling can be arranged proximate, or on top of heating walls 30. Thus, coking ovens 34 are formed by floor 28, heating walls 30, and the oven ceiling. A battery top can be arranged on top of heating walls 30 and may enclose flues 32. In the exemplary illustration, ducts 100 (also indicated by "100" in FIG. 2) may be arranged to form the battery top or a portion thereof, thus sealing flues 32—a substantial and significant improvement over previous attempts (discussed in greater detail, infra). In some embodiments, each flue 32 is in fluid communication with at least one hole 46 and at least one hole 48, which thereby provides gas (via hole 46) and air (via hole 48) to its respective flue. The arrangement of having at least one gas injection hole 46 and an air injection hole 48 into a single flue provides a desirable combustion mixture of air and fuel.

Duct

The following description should be taken in consideration of FIGS. 3A through 3D, which generally illustrate a perspective view, a front view, a top view and a skeleton perspective view of duct 100, respectively. Duct 100 generally includes first end 101, second end 102, first side 103, second side 104, and passageway 105 arranged therein. Duct 100 is preferably formed by top section 110 and bottom section 150. Top section 110 generally includes external surface 111 and internal surface 112. Top section 110 also comprises channel 120, disposed within internal surface 112 and extending from first end 101 to second end 102 of duct 100. Bottom section 150 generally includes external surface 151 and internal surface 152. Bottom section 150 also comprises channel 160, disposed within internal surface 152 and extending from first end 101 to second end 102 of duct 100. Bottom section 150 further comprises inner channel 162, disposed within channel 160 and extending from first end 101 to second end 102 of duct 100. Bottom section 150 is arranged to accept top section 110 thereon, forming duct 100 via mortar to fixedly secure the top and bottom sections, or other acceptable securement means, discussed in further detail, infra.

Top section 120 also includes first aperture 122 and second aperture 124, both of which have an opening disposed on external surface 111 and an opposite opening disposed within channel 120. Bottom section 150 also includes first aperture 164 and second aperture 166, both of have an opening disposed on external surface 151 and an opposite opening disposed within inner channel 162 of channel 160. Apertures 122 and 124 of top section 110 are in communication with passageway 105 of duct 100. Apertures 122 and 124 may provide for/are inspection ports for the flues positioned under duct 100.

As shown in FIG. 2, apertures 164 and 166 are in communication with a flue disposed distally in relation to duct 100. Apertures 164 and 166 are also in communication with passageway 105 of duct 100. It should be noted that an adjacently connected duct may be indicated by "100'".

Figure 5A:
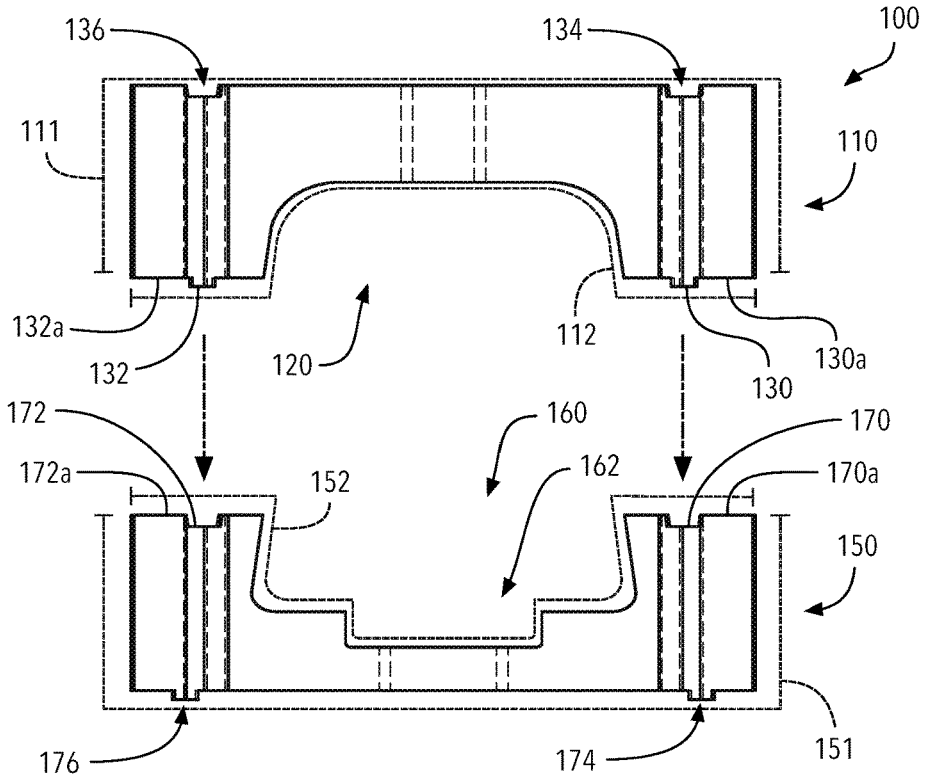
FIG. 5A generally illustrates a front exploded view of the invention shown in FIG. 3A FIG. 5B generally illustrates a cross-sectional view taken generally along line 5B-5B in FIG. 3C.

The following description should be taken in view of the aforementioned illustrations and FIGS. 4A through 5A. Top section 110 and bottom section 150 of duct 100 include means to interconnect sections 110 and 150 when section 110 is engaged to section 150. Top section 110 includes connecting protrusions 130 and 132, extending from internal surface 112 of top section 110 and more specifically arranged to extend in a direction away from apertures 122 and 124. Bottom section 150 includes connecting grooves 170 and 172, disposed within internal surface 152 of bottom section. As best illustrated in FIG. 5A, external surface 111 of top section 110 and external surface 151 of bottom section 150, comprise the surfaces which are externally exposed, i.e., not within passageway 105 of duct 100 (formed when top section 110 is arranged on bottom section 150), and not the surfaces generally arranged to abut when top section 110 is arranged on bottom section 150 (the surfaces having connecting protrusions 130 and 132 of top section 110 and the surfaces having connecting grooves 170 and 172 of bottom section 150). More particularly, connecting protrusions 130 and 132 are arranged on connecting surfaces 130*a* and 132*a* of internal surface 112 of top section 110, respectively, whereas connecting grooves 170 and 172 are arranged on connecting surfaces 170*a* and 172*a* of internal surface 152 of bottom section 150.

When duct 100 is formed (top section 110 is engaged to bottom section 150, as shown in FIGS. 3A through 3D), connecting protrusions 130 and 132 are seated within connecting grooves 170 and 172, respectively. In some configurations of duct 100 connecting surfaces 130*a* and 132*a* are arranged to abut connecting surfaces 170*a* and 172*a*, whereas in other configurations, there may be a mortar arranged between 130*a* and 132*a* and connecting surfaces 170*a* and 172*a*.

Top section 110 may also include connecting grooves 134 and 136, disposed within external surface 111. Bottom section 150 may also include connecting protrusions 174 and 176, disposed on external surface 151. Connecting grooves 134 and 136 may be arranged to engage an indicator cap that is arranged to be placed on top of top section 110, i.e., indicator cap may have protrusions extending therefrom which are arranged to rest within connecting grooves 134 and 136. Connecting protrusions 174 and 176 may be arranged to engage the top section of a flue component arranged under bottom section 150 of duct 100, i.e., the top section of a flue component may have grooves disposed therein which are arranged to accept connecting protrusions 174 and 176 therein. Connecting protrusions 130-136 generally are arranged to be seated within a respect groove to increase the connection of that component, i.e., preventing excess movement, and to prevent possible leakage from that respective seam. Connecting grooves 170-176 generally are arranged to accept a respective connecting protrusion therein, thereby increasing the connection of that component, i.e., preventing excess movement, and to prevent possible leakage from that respective seam. Additionally, the engagement of a respective connecting protrusion and a connecting groove creates a break in the respective seam such that mortar within the seam and connecting the two components forms a stronger connection.

Figure 3A:
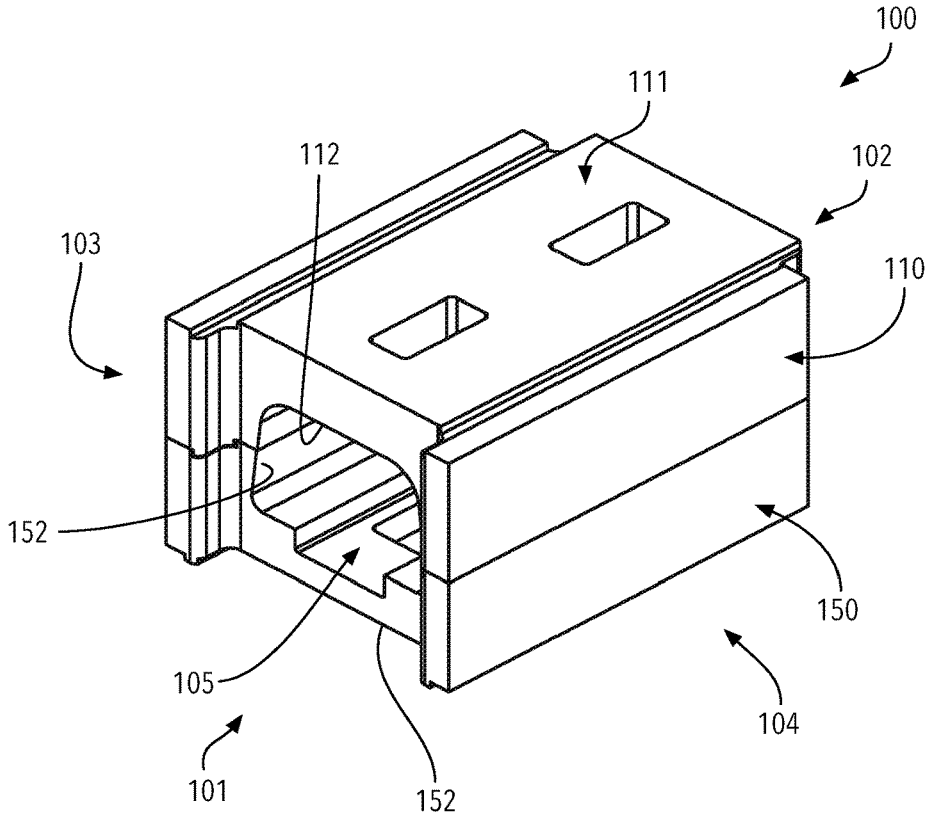
FIG. 3A generally illustrates a perspective view of the present invention.
Figure 3B:
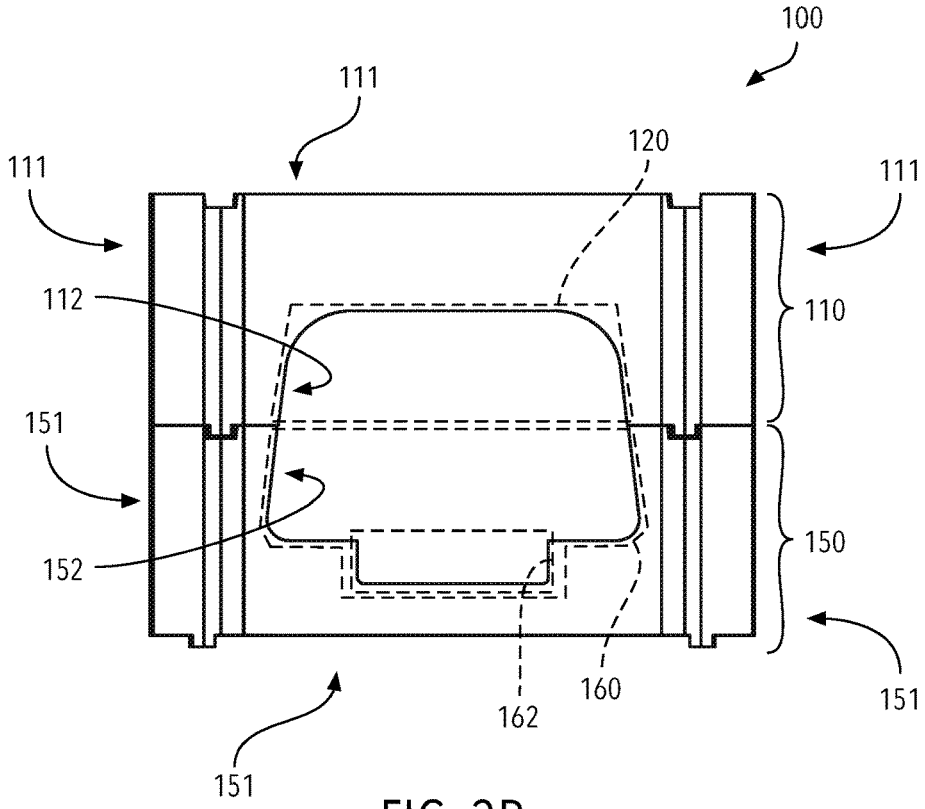
FIG. 3B generally illustrates a front view of the invention shown in FIG. 3A.
Figure 3C:
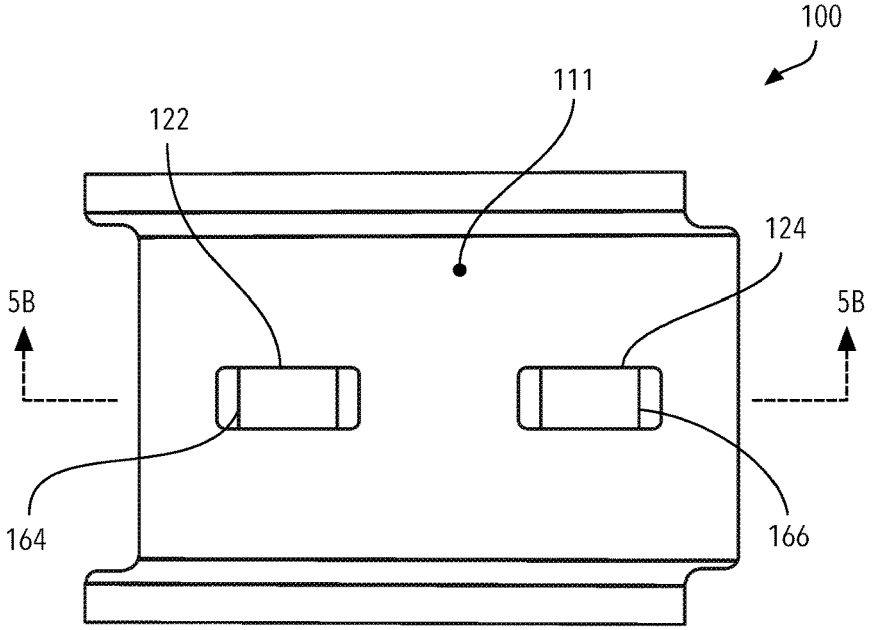
FIG. 3C generally illustrates a top view of the invention shown in FIG. 3A.
Figure 3D:
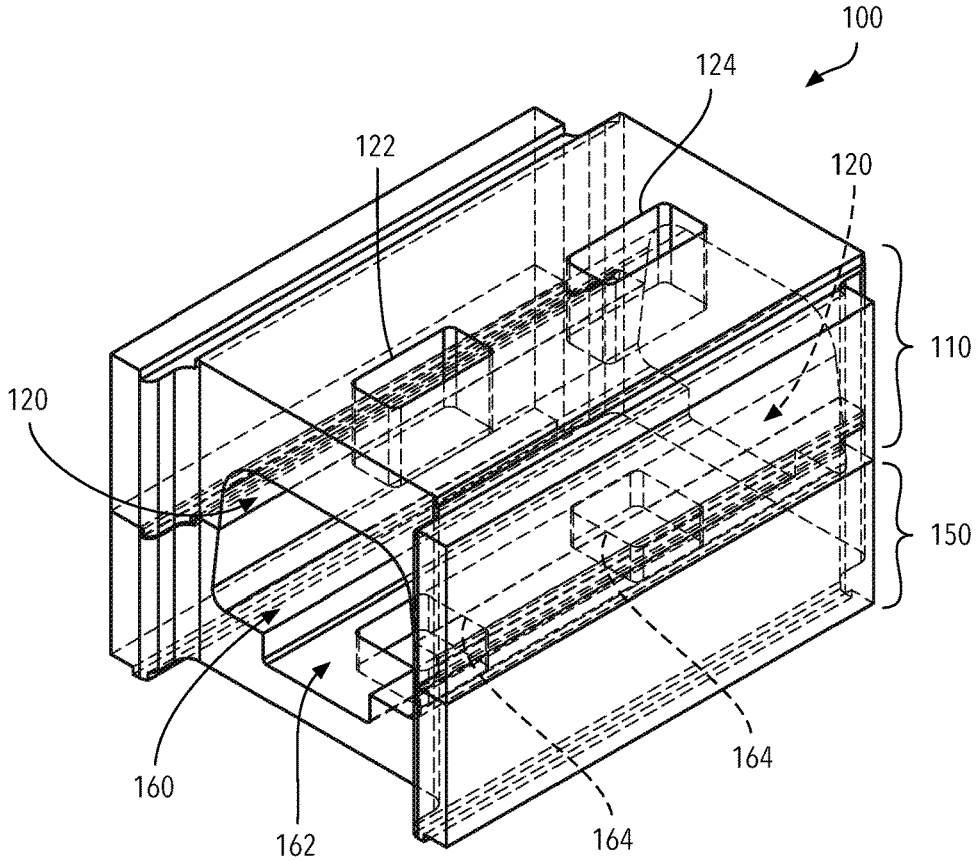
FIG. 3D generally illustrates a skeleton perspective view of the invention shown in FIG. 3A.
Figure 4B:
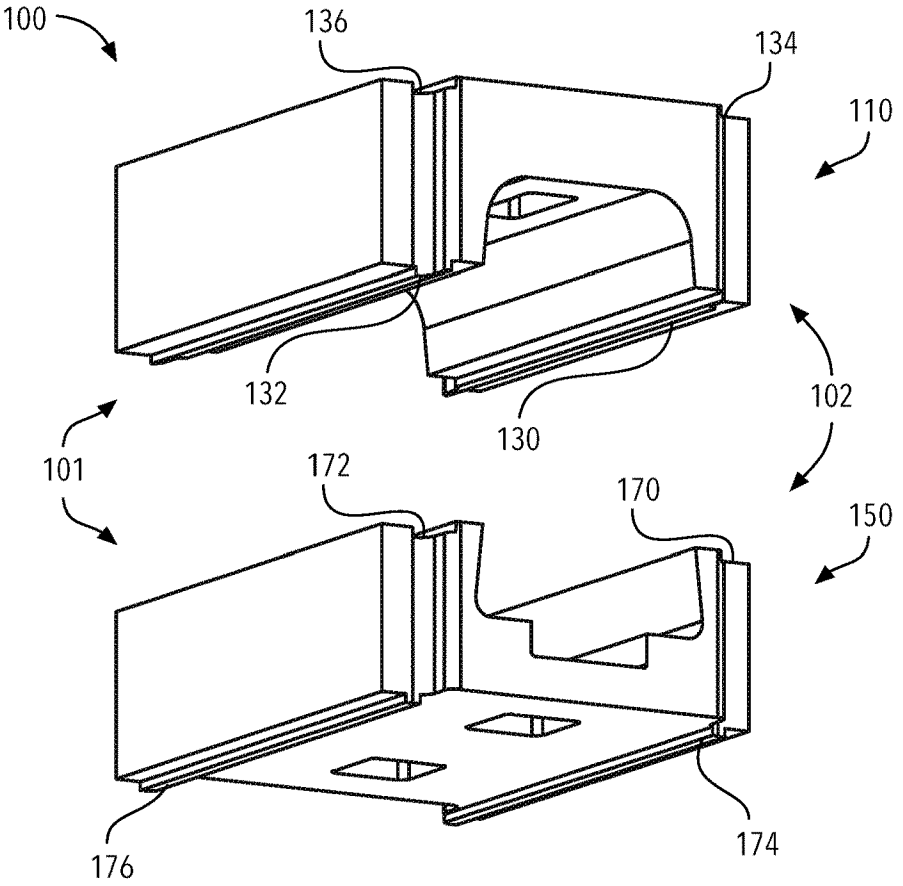
FIG. 4B generally illustrates a different exploded perspective of the invention shown in FIG. 4A.
Figure 4A:
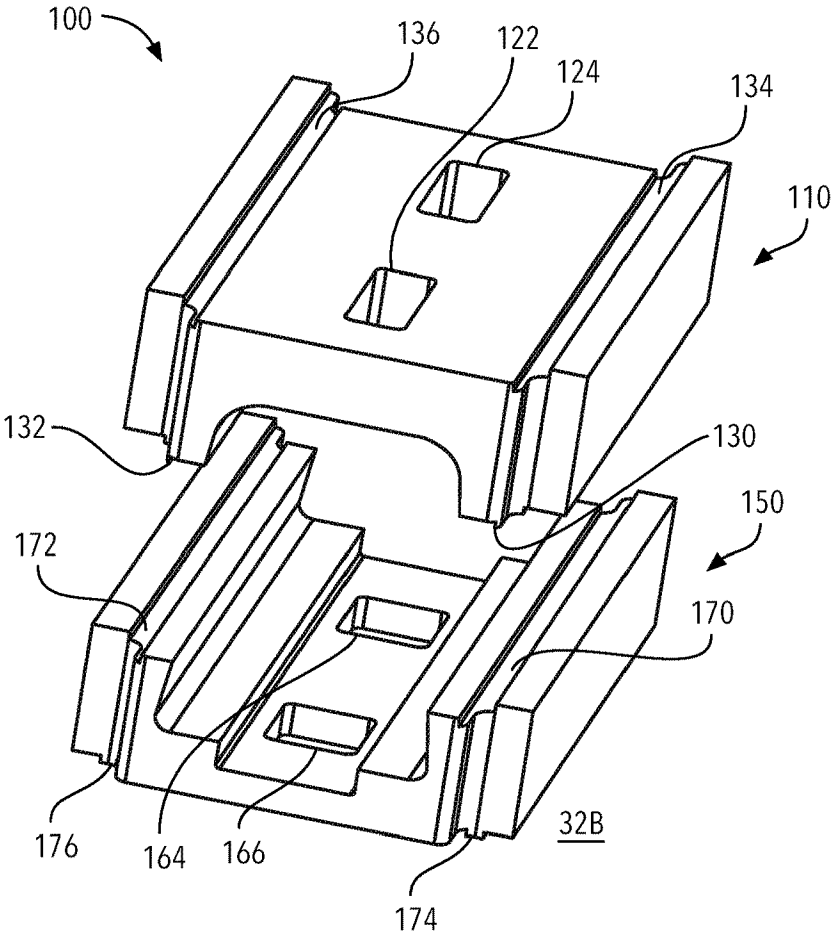
FIG. 4A generally illustrates an exploded perspective view of the invention shown in FIG. 3A.
Figure 5B:
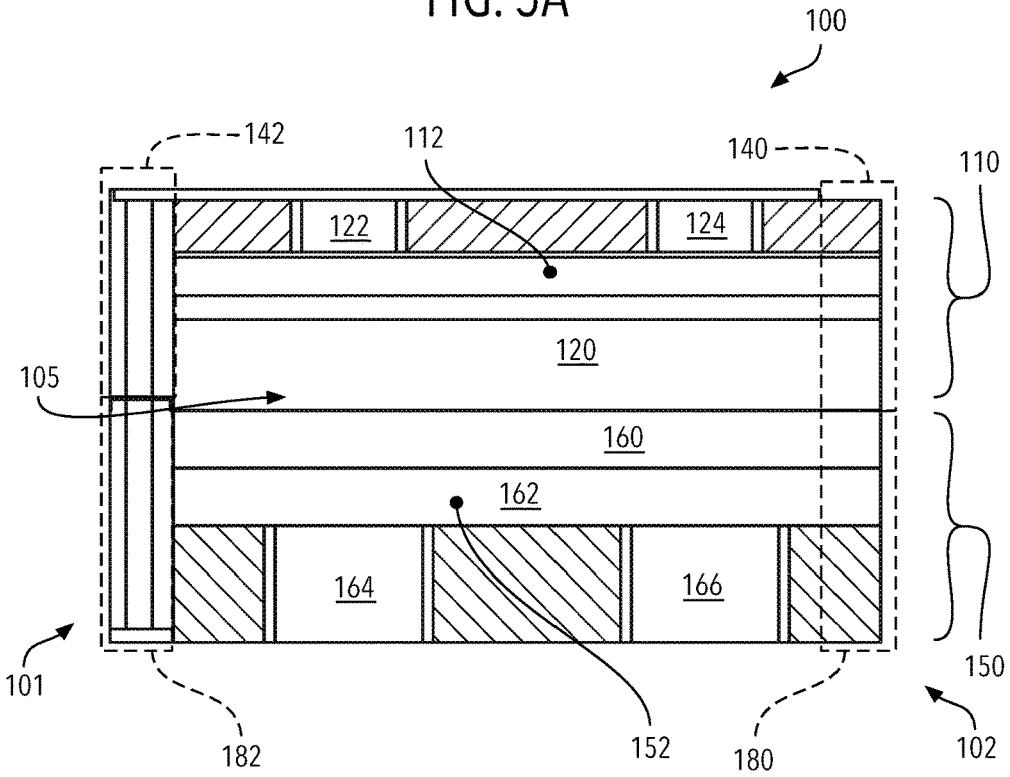
Figure 6:
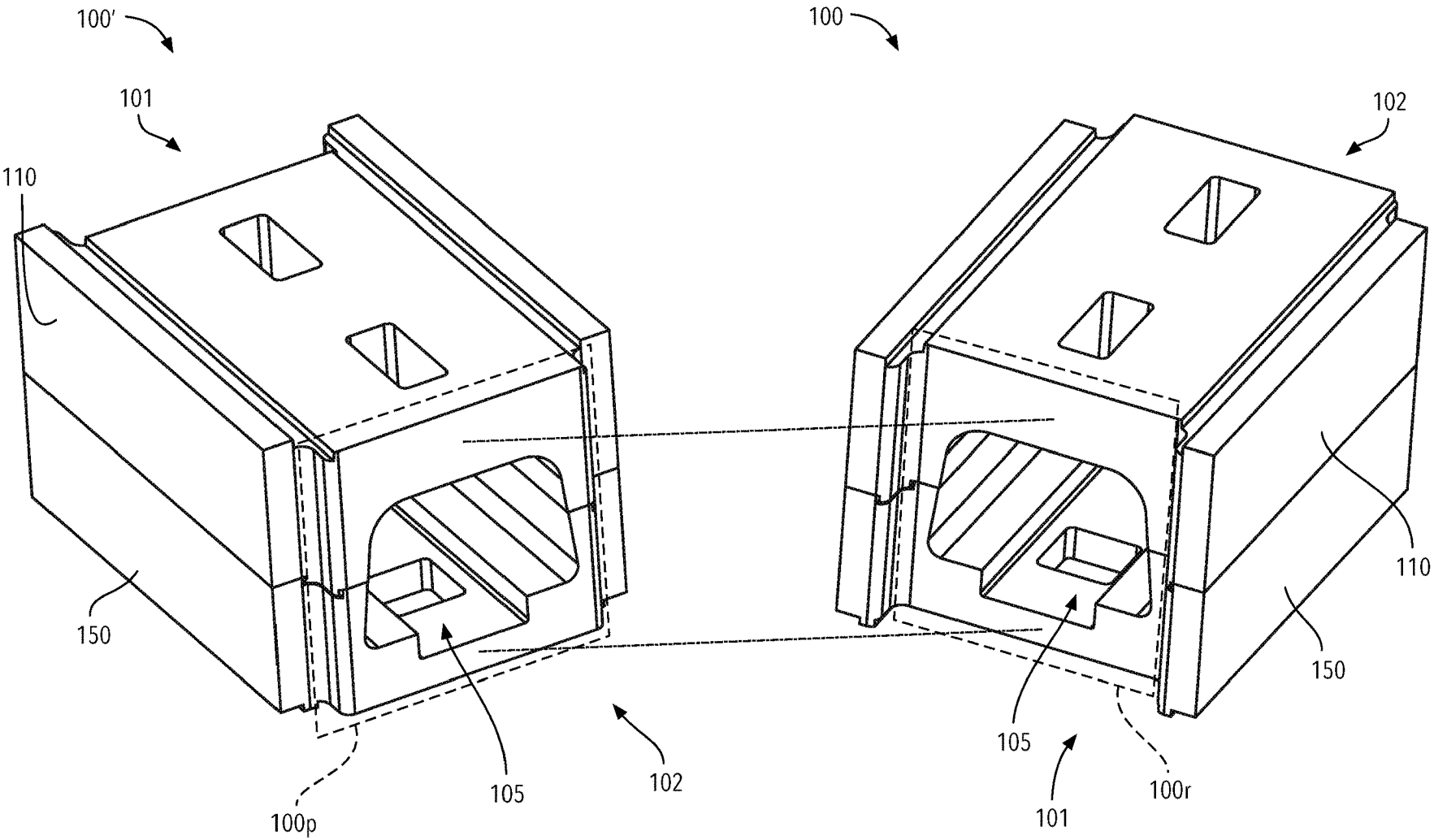
FIG. 6 is a perspective exploded view of two ducts of the present invention; and, FIG. 7 generally illustrates a cross-sectional view of the duct of the present invention and an adjacent duct arranged atop a plurality of flues of a coke oven taken generally from Detail 7 in FIG. 2.

The following description should be considering in view of the aforementioned figures, FIG. 5B and FIG. 6. FIG. 5B is a cross-sectional view of duct 100, taken generally along line 5B-5B in FIG. 3C and FIG. 6 is a perspective view of two ducts, 100 and 100'. In a preferred embodiment, top section 110 includes protruding section 140 and recessed section 142, whereas bottom section 150 includes protruding section 180 and recessed section 182. Protruding sections 140 and 180 are arranged at one of ends 101 or 102 of duct 100. Recessed sections 142 and 182 are arranged at one of ends 101 or 102 of duct 100. To ensure a secure connection between one duct member (100) and another duct member (100'), recessed section 100*r* of duct 100 (comprising recessed sections 142 and 182) are arranged to accept protruding section 100*p* (comprising protruding sections 140 and 180) of duct 100', therein. This arrangement joins top section 110 of duct 100 with top section 110 of duct 100', bottom section 150 of duct 100 with bottom section 150 of duct 100', and passageway 105 of duct 100 with passageway 105 of duct 105—fluidly connecting both passageways, etc. This configuration prevents excess movement between joined duct 100 and duct 100', in addition to more secured seems between duct 100 and duct 100'—preventing possible leaks.

Figure 7:
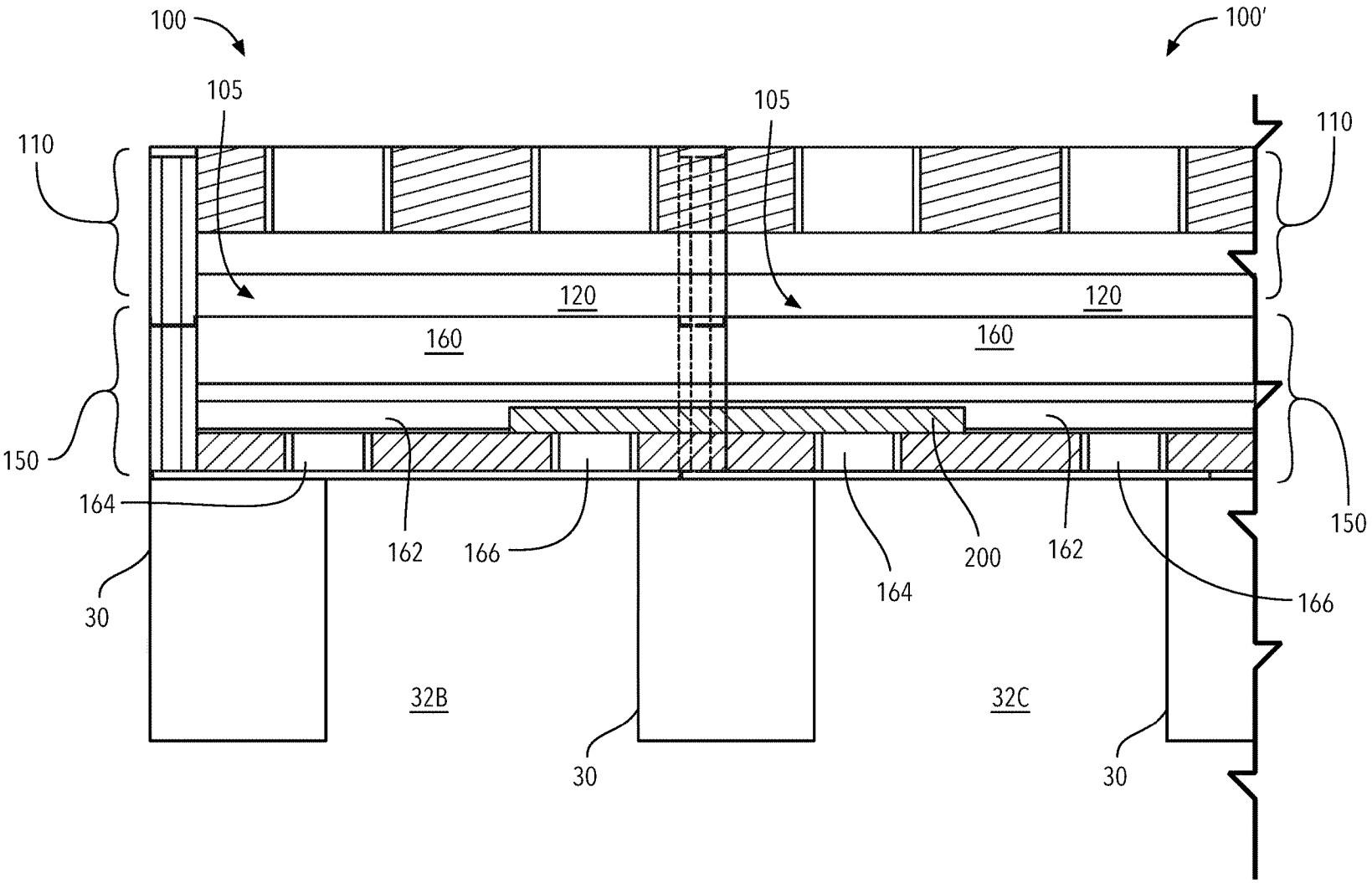

The following description should be taken in view of the aforementioned illustrations and FIG. 7. FIG. 7 is taken generally from Detail 7 shown in FIG. 2. More specifically, FIG. 7 generally illustrates two ducts of the present invention (100 and 100') fixedly secured and thereby in fluid connection with each other. Ducts 100 and 100' are fixedly secured atop heating walls 30. Duct 100 is in fluid connection with flue 32B via apertures 164 and/or 166 and duct 100' is in fluid connection with flue 32C via apertures 164 and/or 166. Duct 100 is in indirect fluid connection with flue 32C via the fluid connection between passageways 105 of ducts 100 and 100' (i.e., apertures 164 and/or 166 of duct 100' to passageway 150 of duct 100' to passageway 150 of duct 100). Duct 100' is in indirect fluid connection with flue 32B via the fluid connection passageways 105 of ducts 100' and 100 (i.e., apertures 164 and/or 166 of duct 100 to passageway 150 of duct 100 to passageway 150 of duct 100').

As recited supra, bottom section 150 of duct 100 includes channel 160 and inner channel 162—illustrated in FIG. 7 with inner channels 162 of ducts 100 and 100', joined together. Inner channel 162 is configured to accept plate 200 therein. Plate 200, all known as a slider brick or block, may take a variety of forms, so long as plate 200 is able to block, i.e., disrupt the fluid connection recited supra, at least one of apertures 164 or 166. FIG. 7 illustrates plate 200 within inner channel 162 of duct 100 and within inner channel 162 of duct 100', such that plate blocks aperture 166 of duct 100 and aperture 164 of duct 100'. This configuration (inner channel 160 within passageway 105) allows an operator to control the flow and exchange of gases, and/or heat, more precisely between two different flues of a coke oven. In the exemplary illustration shown in FIG. 7, only aperture 164 of duct 100 is in fluid connection with flue 32B (and in indirect fluid connection with flue 32C) and only aperture 166 of duct 100' is in fluid 30 connection with flue 32C (and in indirect fluid connection with flue 32B)—plate 200 is blocking the respective fluid connection of aperture 166 of duct 100 and flue 32B and is also blocking the respective fluid connection of aperture 164 of duct 100' and flue 32C. Plate 200 is arranged to be moved, slid, within inner channels 162 of ducts 100 and/or 100', such that an operator may selectively move plate 200 to change the fluid connections between duct 100 and/or 100' and flue 32B and/or 32C.

The following description should be taken in view of all of the aforementioned illustrations. Duct 100, although generally depicted as comprising top section 110 and bottom section 150, may alternatively be configured as singular component, thereby removing the seams between top section 110 and bottom section 150.

Top section 110 and bottom section 150 of duct 100 may be connected or joined, via any suitable means, for example, adhesives, mortar, interference or press fit, bolts, rods, etc. Duct 100 may be connected or joined to an adjacent duct (as shown in FIG. 7) via any suitable means, for example, adhesives, mortar, interference or press fit, bolts, rods, etc. Duct 100 may be connected or joined atop a heating wall of a coke oven (as shown in FIGS. 1, 2, and 7) via any suitable means, for example, adhesives, mortar, interference or press fit, bolts, rods, etc.

As best shown in FIG. 2, duct 100 is arranged on heating wall 30. Specifically, bottom section 150 is arranged on top of a module of a preceding (i.e., elevationally lower) tier. In some embodiments, top section 110 is operatively arranged to be the roof or the last tier of the coke oven battery before the roof. In some embodiments, duct 100 is arranged just below the roof. In some embodiments, top section 110 is operatively arranged to be the battery top, thereby enclosing the flue. For example, apertures 122 and 124 may comprise plugs arranged therein, which seal passageway 105 along a topmost surface of external surface 111. An operator can remove the plugs in order to inspect the respective the flue for that duct 100 and inspect and/or displace the plate or slider bricks (as shown in FIG. 7) that is/are arranged in inner channel 162 of bottom section 150. As previously described, the plate or slider bricks can be used to block or partially block apertures 164 and/or 166 in order to control the flow of exhaust gasses between flues. For example, when apertures 164 and/or 166 are in an open state (i.e., no blockage thereon), fluid, gas, or heat, can flow from flue 32B into its duct 100 and over into flue 32C via its duct 100'—arrow A1. Similarly, fluid can flow from flue 32C into its duct 100' and over into flue 32B via its duct 100—arrow A2. In some arrangements of the present invention, duct 100 is arranged such aperture 164 is aligned with a first flue (e.g., flue 32B) and aperture 166 is aligned with a second flue (e.g., flue 32C). In this configuration, blocking one hole, for example aperture 166, would prevent fluid from entering duct 100 from flue 32C. Such arrangement and ability to control the flow of fluid (i.e., exhaust gasses) between flues of the same heating wall provides for optimal heating characteristics and improved control of specific heating requirements between the flues.

It will be appreciated that various aspects of the disclosure above and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

LIST OF REFERENCE NUMERALS

10 Coke oven battery
20 Regenerator
22 Pier or pillar
24 Regenerator region
28 Floor
30 Heating wall(s)
32 Flue(s)
32A Flue
32B Flue
32C Flue
32D Flue
32E Flue
34 Oven
40 Corbel
42 Through-bore
46 Hole
48 Hole
100 Duct
100' Adjacent duct
100*p* Protruding section of duct 100/100'
100*r* Recessed section of duct 100/100'
101 First end of duct 100
102 Second end of duct 100
103 First side of duct 100
104 Second side of duct 100
105 Passageway of duct 100
110 Top section of duct 100
111 External surface of top section 110
112 Internal surface of top section 110
120 Channel of top section 110
122 First aperture of top section 110
124 Second aperture of top section 110
130 Connecting protrusion of top section 110
130*a* Connecting surface of internal surface 112
132 Connecting protrusion of top section 110
132*a* Connecting surface of internal surface 112
134 Connecting protrusion of top section 110
136 Connecting protrusion of top section 110
140 Protruding section of top section 110
142 Recessed section of top section 110
150 Bottom section of duct 100
151 External surface of bottom section 150
152 Internal surface of bottom section 150
160 Channel of bottom section 150
162 Inner channel of channel 160
164 First aperture of bottom section 150
166 Second aperture of bottom section 150
170 Connecting groove of bottom section 150
170*a* Connecting surface of internal surface 152
172 Connecting groove of bottom section 150
172*a* Connecting surface of internal surface 152
174 Connecting groove of bottom section 150
176 Connecting groove of bottom section 150
180 Protruding section of bottom section 150
182 Recessed section of bottom section 150
200 Cover plate of duct 100/100'
300 Coal
A1 Arrow
A2 Arrow

What is claimed is:

1. A duct operatively arranged to fluidly connect a first flue of a heating wall of a coke oven battery with a second flue of the heating wall, the duct comprising:

a bottom section having a first end and a second end, the bottom section having an external surface and an internal surface, the bottom section having a channel disposed within the internal surface extending from the first end to the second end, the channel having an inner channel disposed therein, the inner channel having a pair of distal apertures disposed therein, one of the pair of distal apertures in fluid communication with the first flue, another of the pair of distal apertures in fluid communication with the second flue, a top section having a first end and a second end, the top section having an external surface and an internal surface, the top section having a channel disposed within the internal surface extending from the first end to the second end, the channel having a pair of apertures disposed therein, wherein the bottom section is arranged to accept the top section thereon forming a passageway comprising the channels of the bottom section and the channel of the top section.

2. The duct recited in claim 1, wherein the bottom section includes at least one groove arranged proximate from the channel and arranged within the internal surface, the at least one groove extending from the first end to the second end; and, wherein the top section includes at least one protrusion arranged proximate from the channel and extending from the internal surface, the at least one protrusion extending from the first end to the second end.

3. The duct recited in claim 2, wherein the at least one groove of the bottom section is arranged to accept the at least one protrusion of the top section therein.

4. The duct recited in claim 1 further comprising:

a mating projection extending from the second end of the bottom section; and, a mating recess disposed within the first end of the bottom section; and, a mating projection extending from the second end of the top section; and, a mating recess disposed within the first end of the top section.

5. The duct recited in claim 4, wherein the mating projection of the top section is arranged to engage a mating recess of a top section of an adjacently arranged duct and wherein the mating projection of the bottom section is arranged to engage a mating recess of a bottom section of the adjacently arranged duct.

6. The duct recited in claim 1, wherein the bottom section includes at least one protrusion extending from the external surface and extending from the first end to the second end; and, the top section includes at least one groove arranged within the external surface and extending from the first end to the second end.

7. The duct recited in claim 1, wherein each of the pair of apertures of the top section are arranged to be substantially aligned with an inspection casting arranged on the external surface of the top section.

8. The duct recited in claim 1, wherein:

the bottom section comprises one or more of:

at least one groove arranged proximate the channel and arranged within the internal surface, the at least one groove extending from the first end to the second end; or, at least one protrusion extending from the external surface and extending from the first end to the second end; and, the top section comprises one or more of:

at least one protrusion arranged proximate the channel and extending from the internal surface, the at least one protrusion extending from the first end to the second end; or, at least one groove arranged within the external surface and extending from the first end to the second end.

9. The duct recited in claim 1, further comprising a plate, the plate arranged to be removably seated within the inner channel, the plate further arranged to cover at least one of the pair of distal apertures disposed within the inner channel.

10. A coke oven battery, having a heating wall, a first flue, and a second flue spaced apart from the first flue, comprising the duct recited in claim 1, wherein the duct is operatively arranged to fluidly connect the first flue to the second flue.

* * * * *